US009038335B1

(12) United States Patent
Eck et al.

(10) Patent No.: US 9,038,335 B1
(45) Date of Patent: May 26, 2015

(54) WINDOW ASSEMBLY

(71) Applicants: Gary A. Eck, Mishawaka, IN (US); John D. Black, Mishawaka, IN (US)

(72) Inventors: Gary A. Eck, Mishawaka, IN (US); John D. Black, Mishawaka, IN (US)

( * ) Notice: Subject to any disclaimer, the term of this patent is extended or adjusted under 35 U.S.C. 154(b) by 0 days.

(21) Appl. No.: 14/102,438

(22) Filed: Dec. 10, 2013

(51) Int. Cl.
*E04B 7/00* (2006.01)
*E06B 3/26* (2006.01)

(52) U.S. Cl.
CPC ..... *E06B 3/26* (2013.01)

(58) Field of Classification Search
CPC ..... E06B 2003/6223; E06B 2003/6226; E06B 3/5842; E04D 2003/085
USPC ..... 52/204.5, 204.597, 204.68, 204.69, 52/204.7, DIG. 1, 127.7, 127.8; 49/504, 49/505
See application file for complete search history.

(56) References Cited

U.S. PATENT DOCUMENTS

| | | | | |
|---|---|---|---|---|
| 3,808,759 | A * | 5/1974 | Carmichael | 52/212 |
| 5,133,168 | A * | 7/1992 | Neilly et al. | 52/204.5 |
| 5,369,922 | A * | 12/1994 | Hansen | 52/204.54 |
| 5,634,508 | A * | 6/1997 | Herbst | 160/371 |
| 5,644,881 | A * | 7/1997 | Neilly | 52/455 |
| 6,272,801 | B1 * | 8/2001 | Suh | 52/211 |
| 6,378,931 | B1 * | 4/2002 | Kolluri et al. | 296/146.15 |
| 6,574,935 | B2 * | 6/2003 | Wang Chen | 52/455 |
| 6,922,946 | B2 * | 8/2005 | Gerard | 49/505 |
| 6,925,767 | B2 * | 8/2005 | Krochmal et al. | 52/455 |
| 7,010,888 | B2 * | 3/2006 | Tumlin et al. | 52/204.56 |
| 7,107,736 | B2 * | 9/2006 | Barnard | 52/745.15 |
| 7,331,142 | B2 * | 2/2008 | Gerard | 49/505 |
| 7,430,836 | B2 * | 10/2008 | Sibbett | 52/208 |
| 7,448,174 | B2 * | 11/2008 | Krochmal et al. | 52/204.54 |
| 7,757,365 | B2 * | 7/2010 | Ouellette | 29/410 |
| 7,788,862 | B2 * | 9/2010 | Wang et al. | 52/205 |
| 7,971,623 | B2 * | 7/2011 | Barnard et al. | 160/116 |
| 8,707,639 | B2 * | 4/2014 | Thompson | 52/204.7 |
| 8,813,442 | B1 * | 8/2014 | Edwards et al. | 52/204.5 |
| 2003/0056442 | A1 * | 3/2003 | Gerard | 49/504 |
| 2004/0000109 | A1 * | 1/2004 | Bourassa et al. | 52/204.54 |
| 2004/0068942 | A1 * | 4/2004 | Krochmal et al. | 52/204.71 |
| 2005/0016091 | A1 * | 1/2005 | Chen | 52/204.1 |
| 2007/0180783 | A1 * | 8/2007 | Amato | 52/204.5 |
| 2010/0251635 | A1 * | 10/2010 | Barnard et al. | 52/127.6 |
| 2014/0352217 | A1 * | 12/2014 | Blackburn et al. | 49/82.1 |

* cited by examiner

*Primary Examiner* — William Gilbert
*Assistant Examiner* — Gisele Ford
(74) *Attorney, Agent, or Firm* — R. Tracy Crump

(57) ABSTRACT

The window assembly uses a releasable press fit frame connection. The window assembly includes a window pane sandwiched between a pair of frame halves that are press fit together by the engagement of a plurality of corresponding male and female connectors integrally formed into the frame halves. The corresponding male and female connectors are spaced apart around the perimeter of frame halves and hold the window assembly within the window openings cut in the wall or door panels. The window assembly of this invention also includes a release key that allows the frame halves to be taken apart. The release key is manually inserted through thin slots formed in the frame halves to disengage the connection between corresponding male connectors and female connectors.

11 Claims, 7 Drawing Sheets

WINDOW ASSEMBLY

This invention relates to window assemblies used in the monocoque laminate wall and door panels found in recreational vehicles, trailers, prefabricated buildings, and similar light weight structures, and in particular a window assembly having a two piece window frame connected by a releasable press fit connection.

BACKGROUND AND SUMMARY OF THE INVENTION

Recreational vehicles, trailers, prefabricated buildings, and similar light weight structures, often use monocoque laminate panels for walls and doors. Monocoque laminate wall panels have an internal wood or metal skeleton and an insulated core sandwiched between outer panel skins. Window assemblies for such wall and door panels generally consist of window panes sandwiched between two window frame halves. The window assemblies are fitted within openings cut in the wall and door panels. Heretofore, screws and other fasteners are used to secure the two frame halves together so that the window assembly can be taken apart in order to replace the broken or cracked window panes.

The window assembly of this invention eliminates the need to connect the frame halves with fasteners by using a releasable press fit frame connection. The window assembly includes a window pane sandwiched between a pair of frame halves that are press fit together by the engagement of a plurality of corresponding male and female connectors integrally formed into the frame halves. The corresponding male and female connectors are spaced apart around the perimeter of the frame halves and hold the window assembly within the window openings cut in the wall or door panels. The window assembly of this invention also includes a release key that allows the frame halves to be taken apart. The release key is manually inserted through thin slots formed in the frame halves to disengage the connection between corresponding male connectors and female connectors. The use of a press fit connection to join the frame halves allows for convenient tool-less installation of the window assembly of this invention. Eliminating the need for screws and fasteners to connect the frame halves also creates a more aesthetically pleasing appearance for the window assembly. Moreover, the window assembly of this invention can be easily disassembled using the release key allowing broken or cracked window panes to readily repaired or replaced.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
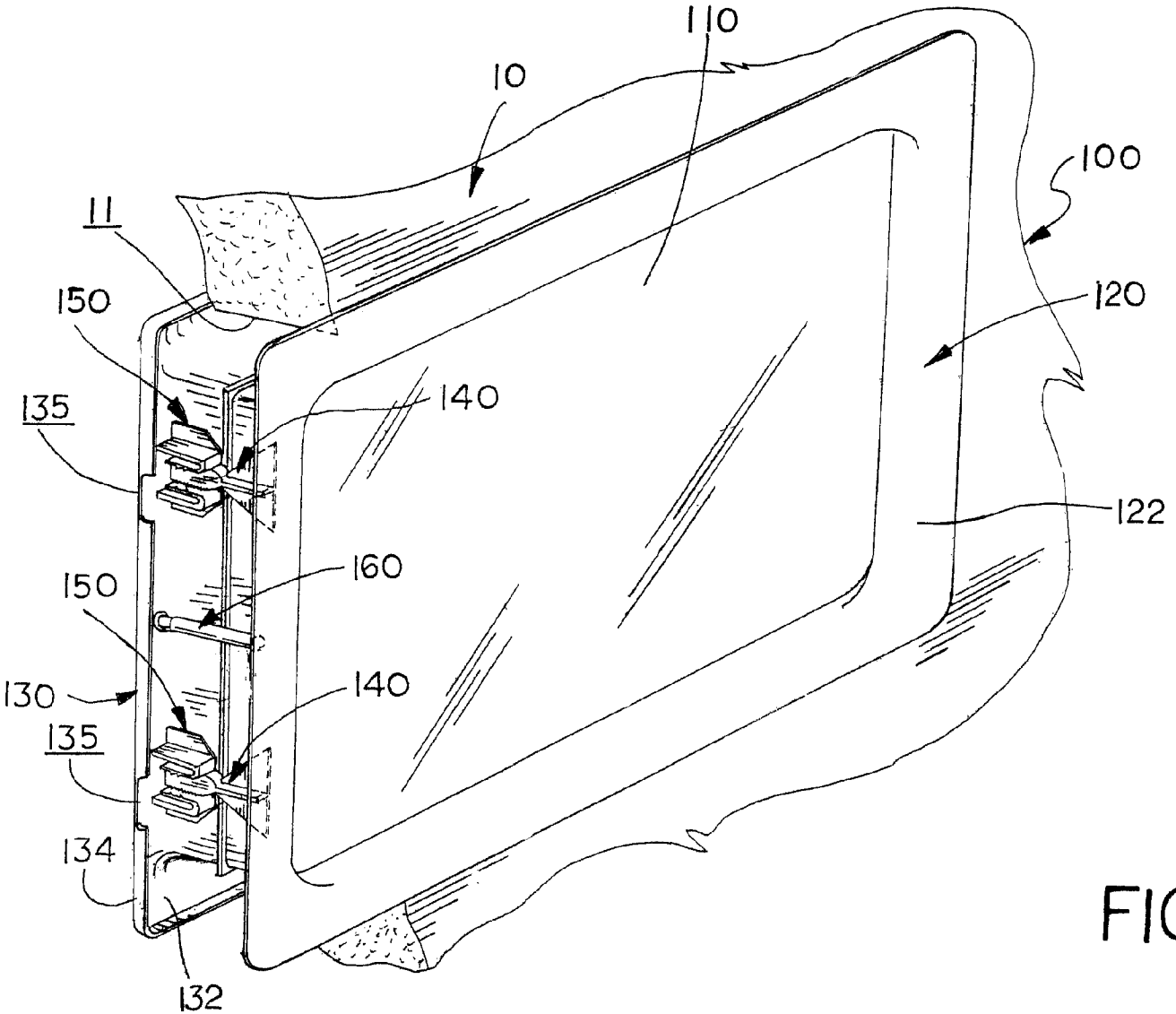
FIG. 1 is a perspective view of an embodiment of the window assembly of this invention.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-4 illustrate an embodiment of the window assembly of this invention, designated generally as reference numeral 100. For ease of explanation, window assembly 100 is illustrated and described hereinafter mounted within a rectangular opening 11 in an exemplary monocoque laminate wall panel 10. Monocoque laminate structural panels are commonly used for wall and doors in recreational vehicles, trailers, prefabricated buildings, and similar lightweight structures. Monocoque laminate wall panels have an internal wood or metal skeleton and an insulated core sandwiched between outer panel skins. Monocoque laminate wall panels are lightweight, thin and sturdy and have finished skin surfaces. While window assembly 100 is illustrated used with a conventional monooque laminate wall panel, the window assembly may be adapted for use in other applications, including other conventional wall or door structures. In addition, window assembly 100 as illustrated is configured to fit into the rectangular space of opening 11, but may be configured and dimensioned to fit into any shape or sized opening in the wall or door panel of the particular application.

Window assembly 100 includes a flat window pane 110 that is sandwiched between two rectangular frame halves 120 and 130. Window pane 110 is illustrated as a single glass pane; however, the window pane may take a variety of forms in other embodiments as desired for its particular application. For example, window pane 110 may be transparent, translucent or opaque, and may be constructed of any suitable material, such as glass or plastic. In addition, window pane 102 may take the form of an insulated glass pane, a mesh screen or similar window structure in other embodiments. Window pane 110 is held and sealed between frame halves 120 and 130 by a peripheral adhesive gasket or other suitable caulk, sealant and adhesives using conventional window construction techniques. Typically, frame halves 120 and 130 are configured with recessed shoulders and other integral retaining structures intended for receiving the particular style and thickness of window pane. In other embodiments the window pane may be integrated directly into one of the frame halves, as desired.

Frame halves 120 and 130 are ideally form, molded or otherwise fabricated from a suitable plastic. The construction material is selected to provide sufficient strength and durability to window assembly 100, as well as provide sufficient resilience for the integral press fit connection members, which are formed as part of the frame halves. Frame halves 120 and 130 are configured to fit their intended opening and as shown have a generally rectangular configuration. Frame halves 120 and 130 are configured to couple together and share many structural features. Frame half 120 includes a flat peripheral flange 122 that abuts and overlies one side of wall panel 10 when window assembly 100 is seated within the window opening 11. A gaskets 112 is used between flange 122 and wall panel 100 to seal window assembly within opening 11. Frame half 130 is similar in configuration to frame half 120. Frame half 130 also includes a flat peripheral flange 132 that abuts and overlies one side of wall panel 10 when window assembly 100 is seated within the window opening 11. However, flange 132 terminate in an in turned peripheral lip 134 that abuts against wall panel 10.

Figure 2:
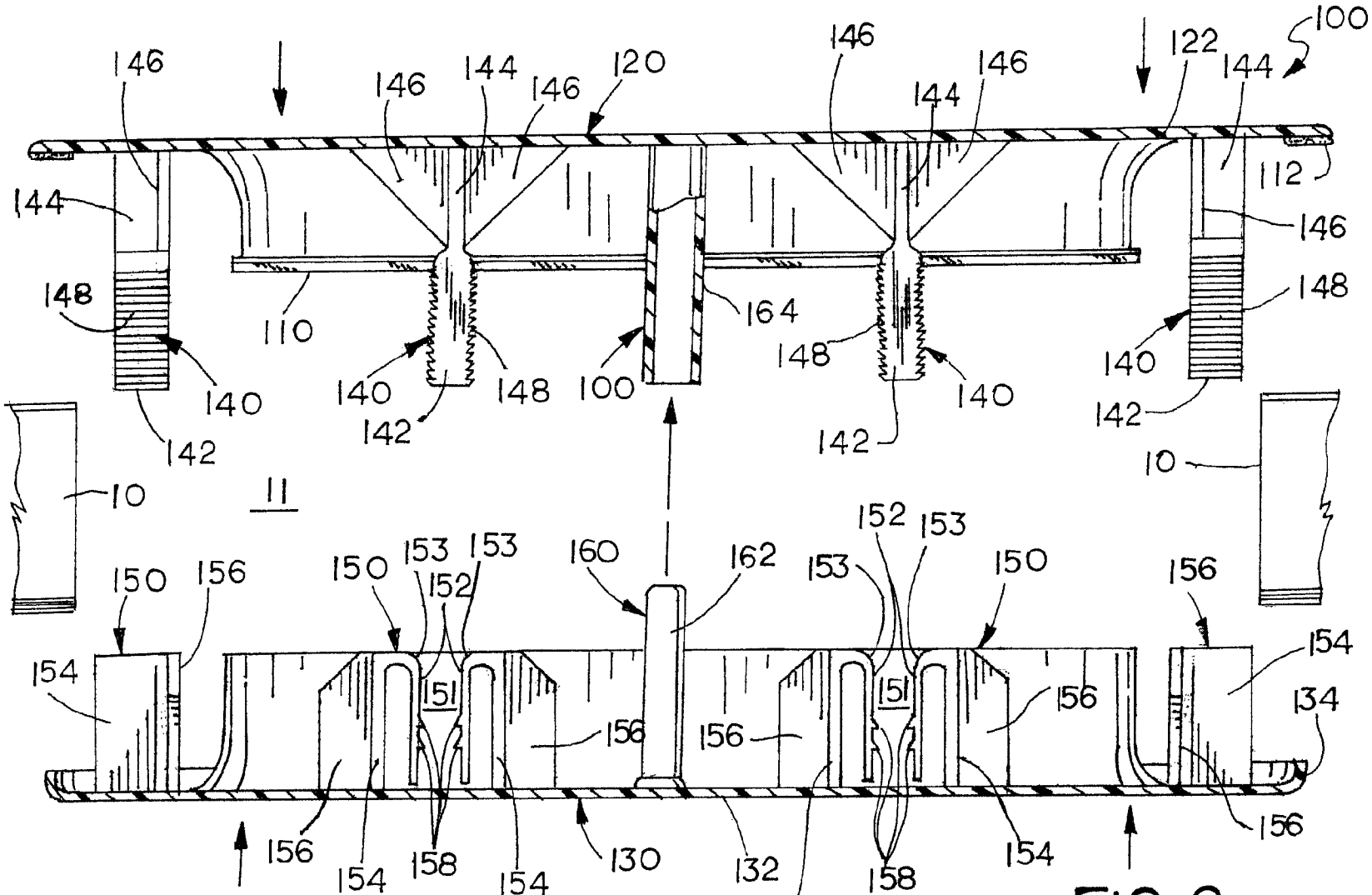
FIG. 2 is a side view of the window frame of FIG. 1 with portions cutaway shown in a disassembled state.
Figure 3:
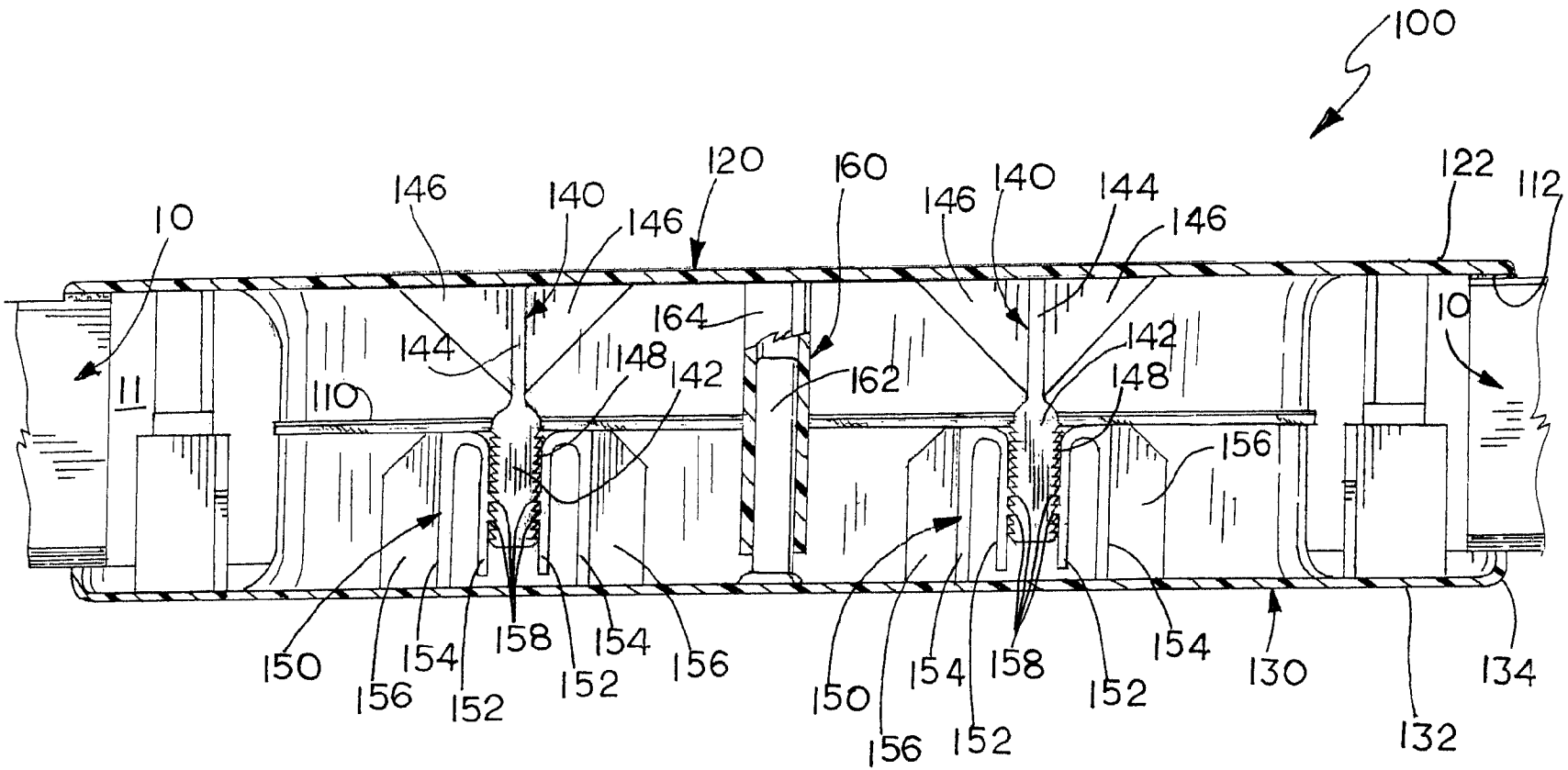
FIG. 3 is a side sectional view of the window frame of FIG. 1 with portions cutaway shown in an assembled state.
Figure 4:
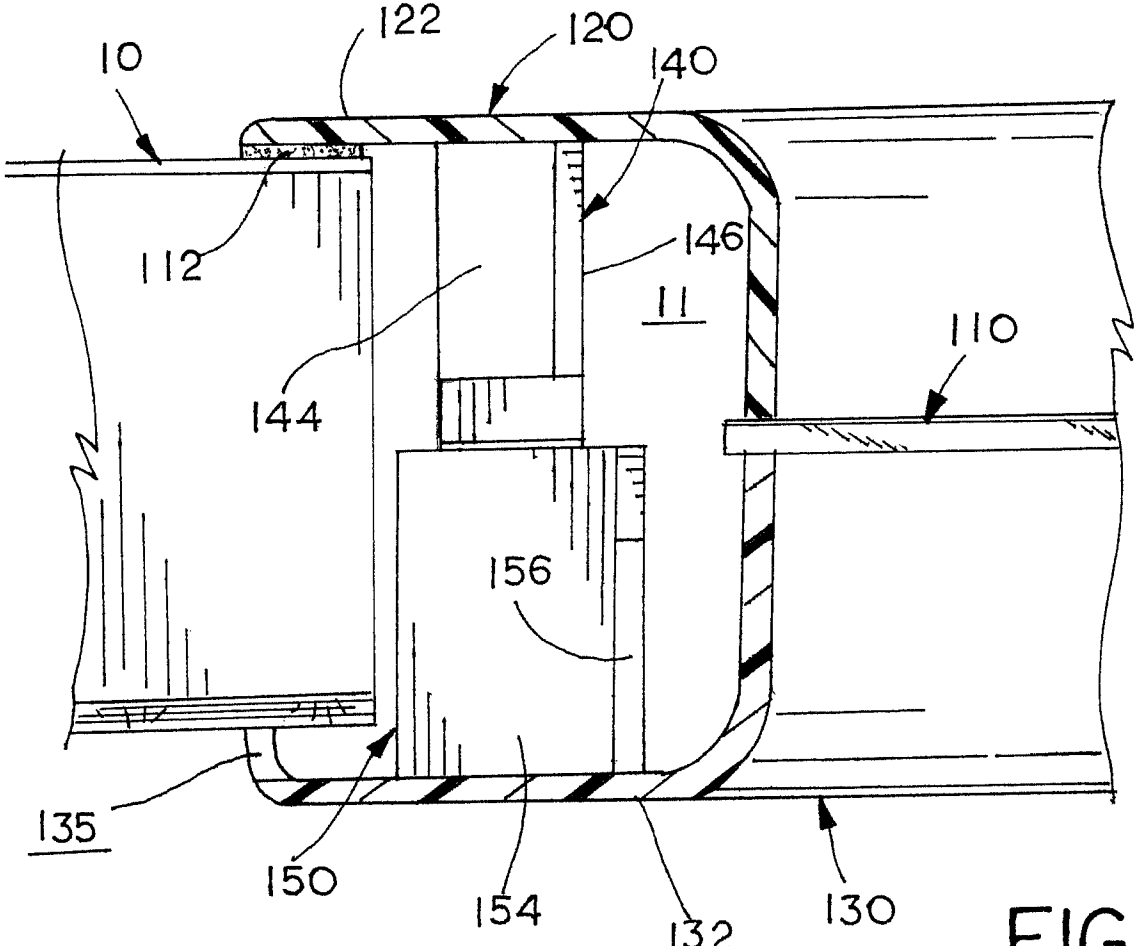
FIG. 4 is a partial side sectional view of the window frame of FIG. 1 shown in an assembled state.

As shown in FIGS. 1-4, frame halves 120 and 130 are detachably connected by the engagement of a plurality of corresponding male and female connectors 140 and 150 integrally formed into the frame halves 120 and 130, respectively. The corresponding male and female connectors 140 and 150 are spaced apart around the perimeter of frame halves 120 and 130. Male connector parts 140 extend perpendicularly from the inner face of flange 122 and is inset from the outer edge of the flange. Male connector parts 140 include an integral head 142, neck 144 and pair of triangular buttresses 146. Head 142 has a plurality of parallel transverse contact ribs 148 formed on opposed sides 146 thereof. Female connector parts 150 consist of two facing resilient contact walls 152, each integrally suspended from an upright support wall 154 and buttress 156 that extend perpendicularly from the inner face of flange 132. Each contact wall 152 is integrally connected to its support wall 154 at their proximal ends, which form a curved shoulder transition 153 so that contact wall 152 is spaced from and parallel to its support wall. The distal end of each contact wall 152 extends toward flange 132 is spaced over inner face of flange 122 (FIGS. 2 and 3). Each of the facing contact walls 152 has a pair of transverse contact ribs 158. The facing contact walls 152 of each female connector 150 are spaced from each other to form a gap 151 within which head 142 of the corresponding male connector part is restrictively received.

Figure 5:
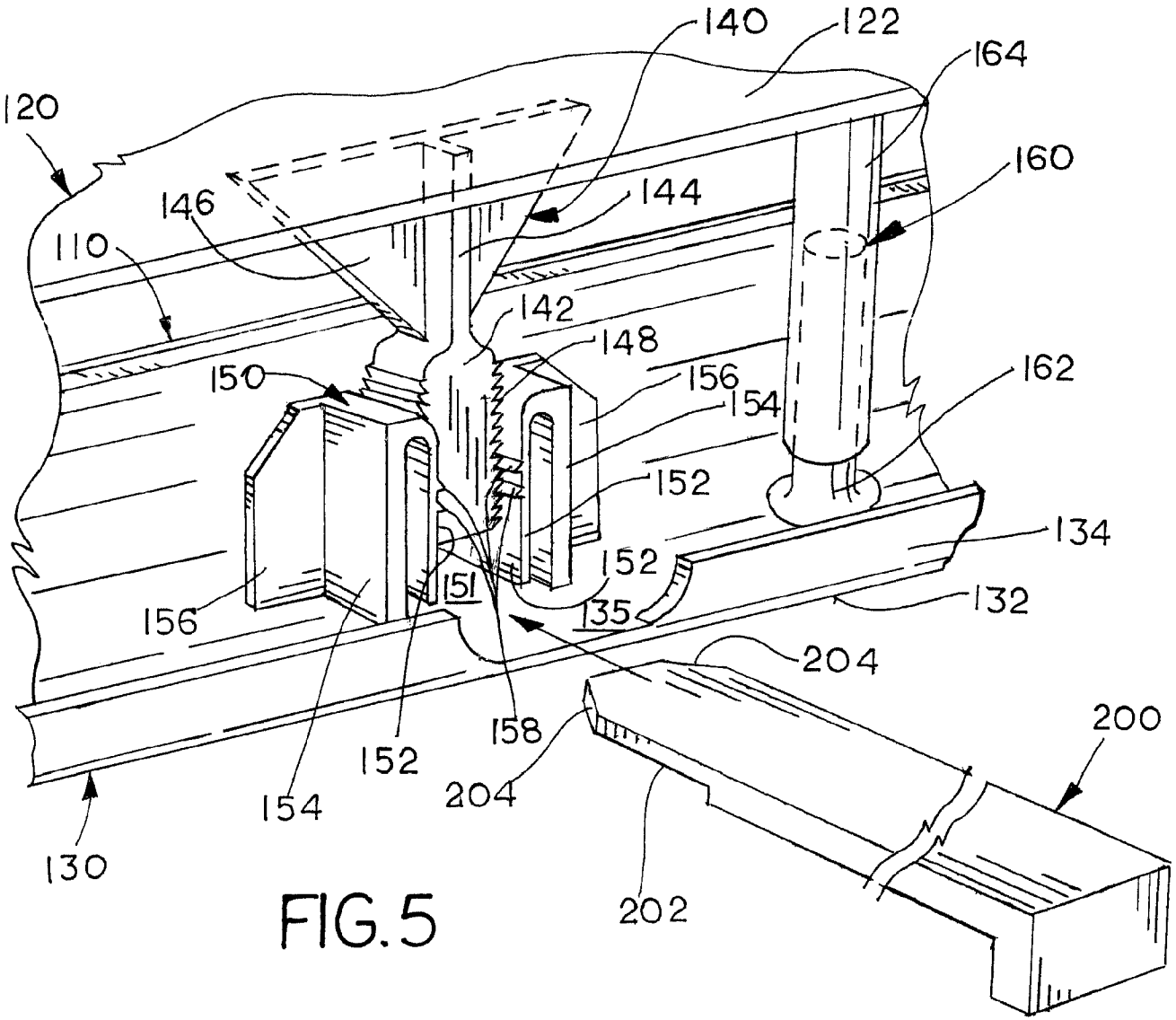
FIG. 5 is a partial perspective view of the window frame of FIG. 1 and the release key.
Figure 6:
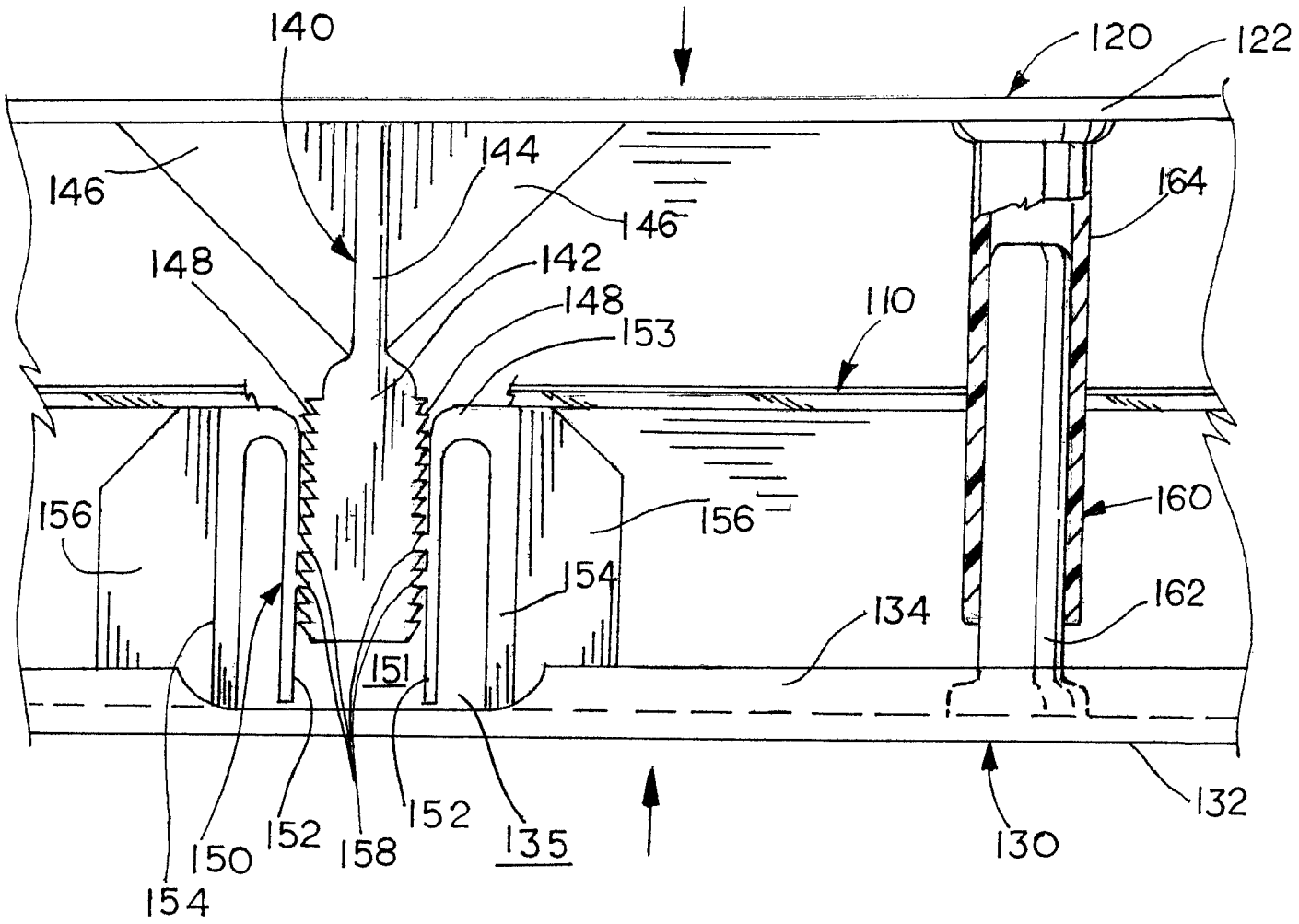
FIG. 6 is a partial side sectional view of the window frame of FIG. 1 shown in an assembled state.

When joined, frame halves 120 and 130 are aligned on opposite sides of wall panel 10 and manually pressed together within opening 11. When pressed together, heads 142 of male connector parts 140 extend into gaps 151 of their corresponding female connector 150 so that ribs 148 formed in sides 146 of each of heads 142 restrictively mesh against and engage ribs 158 of adjacent facing contact walls 152 (FIGS. 3, 5 and 6). The engagement of the meshing ribs 148 and 158 prevent male connectors 140 from being inadvertently withdrawn from their corresponding female connectors 150, thereby coupling frame halves 120 and 130.

Frame halves 120 and 130 also include two sets of alignment guides 160. Generally, alignment guides 160 are centered at opposed ends of frame halves 120 and 130 and help align the frame halves when fitting window assembly 100 with open 11. Each alignment guide 160 includes a guide tube 162, which extends perpendicularly from flange 122 and a guide post 164, which extends perpendicular from the inner face of flange 132. Guide posts 164 extend axially into guide tubes 162 when frame halves 120 and 130 are pressed together. Typically, the length of guide tubes and posts 162 and 164 are selected so that the posts extend into the tubes to align frame halves 120 and 130 before head 142 of male connector parts 140 enters gap 151 of the female connector parts 150 thereby ensuring a positive engagement connection of all connector parts around the periphery of window assembly 100.

Figure 7:
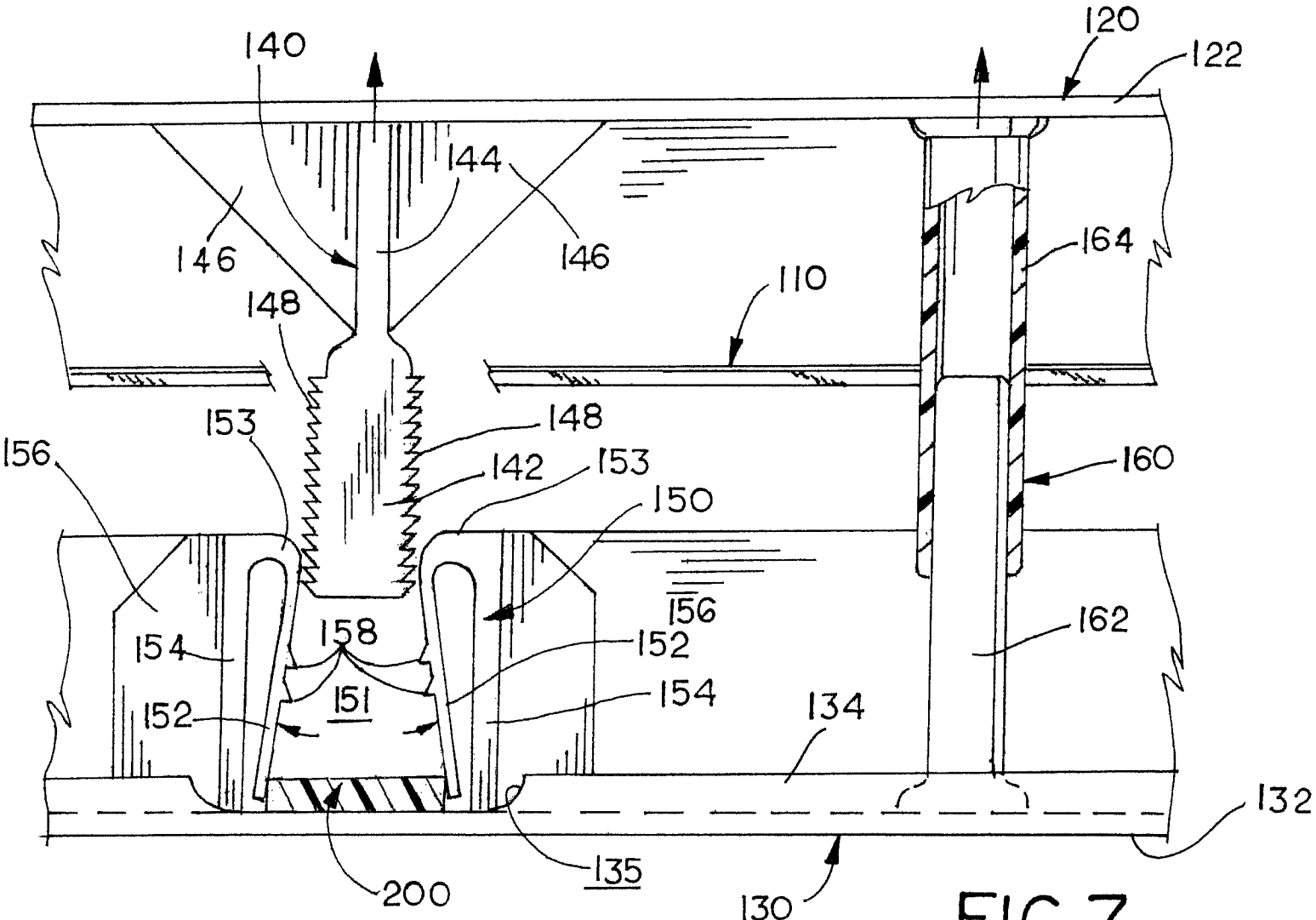
FIG. 7 is a partial side sectional view of the window frame of FIG. 1 shown the key releasing the frames.

FIGS. 5-7 show the release key 200 that is used to uncouple frame halves 120 and 130. Release key 200 allows frame halves 120 and 130 to be uncoupled so that window pane 110 can be replaced. Release key 200 is a flat elongated rectangular length of metal or plastic configured to have a thin tapered end 202 with angled side walls 204. Tapered end 202 is configured to extend through slot openings 135 formed in lip 134 and engage the distal end of contact walls 152. Release key 200 is manually slid through slot 135 between flange 132 and wall panel 10 to forceably spread contact walls 152 pulling ribs 148 and 158 out of engagement thereby allowing frame halves 120 and 130 to be manually pulled apart. Ideally, multiple release keys 200, that is one for each pair of corresponding male and female connectors, are used so that frame halves 120 and 130 can be simultaneously pulled apart; however, a single release key can be used to progressively uncouple the frame halves.

One skilled in the art will note that the use of a press fit connection to join the frame halves eliminates the need for screws and other fasteners to hold the frame halves together. Consequently, the press fit connection allows for convenient tool-less installation of the window assembly of this invention and the lack of screws and screw holes creates a more aesthetically pleasing appearance for the window assembly. Moreover, the window assembly of this invention can be easily disassembled using the release key allowing broken or cracked window panes to be readily repaired or replaced. Formed in the lip of the peripheral flange around one of the frame halves, the small access slots through which the release key extends are small and generally hidden from sight so as to not detract from the appearance of the window assembly. The press fit connection also readily accommodates wall and door panels of slightly varying thicknesses.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

We claim:

1. A window assembly adapted to fit into a window opening in a planar panel comprising:

a first frame half adapted to seat inside the window opening from one side of the panel, the first frame half includes a first connector part extending therefrom;

a second frame half adapted to seat inside the window opening from the opposite side of the panel and detachably connect to the first frame half, the second frame half includes a second connector part extending therefrom and adapted to restrictively abut against the first connector part when the first frame half is pressed against the second frame half to secure the first frame half to the second frame half;

a window pane mountable between the first frame half and the second frame half; and a key part adapted to extend through a slot formed in one of the first frame half and the second frame half for engaging the second connector part to disconnect the first frame half from the second frame half, the first connector part includes a head part, the second connector part includes a resilient wall, the head part abuts against the resilient wall when the first frame half is secured to the second frame half, the head part has a plurality of parallel ribs extending therefrom, the resilient wall also has a rib extending therefrom, the rib of the resilient wall restrictively seated between adjacent ribs of the plurality of ribs of the head part when the first connector part is received within the second connector part, thereby securely connecting the first frame part to the second frame part.

2. The assembly of claim 1 wherein the second connector part includes a second resilient wall spaced from the first resilient wall, the head part restrictively received between the first resilient wall and the second resilient wall when the first frame half is secured to the second frame half.

3. The window assembly of claim 1 wherein one of the first frame half and the second frame half has a peripheral flange overlying the panel around the window opening, the slot formed in the flange adjacent the second connector part when the first frame half and the second frame half are connected.

4. The window assembly of claim 1 wherein the second frame half has a peripheral flange overlying the panel around the window opening and the slot is formed longitudinally through the flange adjacent the second connector part when the first frame half and the second frame half are connected such that the key part extends parallel over the panel when inserted through the slot to engage the second connector part.

5. The assembly of claim 4 wherein the key part displaces the resilient wall from contact with the head part when the key part is inserted through the slot and engaged with the second connector part for disconnecting the first frame half from the second frame half.

6. A window assembly adapted to fit into a window opening in a planar panel comprising:

a first frame half adapted to seat inside the window opening from one side of the panel, the first frame half includes a first connector part extending therefrom, the first connector part includes a head part having a plurality of ribs extending from opposites thereof;

a second frame half adapted to seat inside the window opening from the opposite side of the panel and detachably connect to the first frame half, the second frame half includes a second connector part extending therefrom and adapted to restrictively receive the first connector part when the first frame half is pressed against the second frame half to secure the first frame half to the second frame half, the second connector part includes a first resilient wall and a second resilient wall spaced from the first resilient wall, each of the first resilient wall and the second resilient wall having a rib extending therefrom, the head part restrictively received between the first resilient wall and the second resilient wall when the first frame half is connected to the second frame half so that the rib of the first resilient wall and the rib of the second resilient wall are restrictively seated between adjacent ribs of the plurality of ribs of the head part when the first connector part is received within the second connector part, thereby securely connecting the first frame part to the second frame part, the second frame half has a peripheral flange overlying and parallel to the panel around the window opening and the slot is formed longitudinally through the flange adjacent the second connector part when the first frame half and the second frame half are connected together;

a window pane mountable between the first frame half and the second frame half; and a key part adapted to extend through the slot formed in the second frame half for engaging the second connector part such that the key part displaces the resilient wall from contact with the head part when the key part is inserted through the slot and engaged with the second connector part to disconnect the first frame half from the second frame half.

7. A window assembly adapted to fit into a window opening in a planar panel comprising:

a first frame half adapted to seat inside the window opening from one side of the panel, the first frame half includes a first connector part extending therefrom;

a second frame half adapted to seat inside the window opening from the opposite side of the panel and detachably connect to the first frame half, the second frame half includes a second connector part extending therefrom and adapted to restrictively abut against the first connector part when the first frame half is pressed against the second frame half to secure the first frame half to the second frame half;

a window pane mountable between the first frame half and the second frame half; and a key part adapted to extend through a slot formed in one of the first frame half and the second frame half for engaging the second connector part to disconnect the first frame half from the second frame half, one of the first frame half and the second frame half has a peripheral flange overlying the panel around the window opening, the slot formed in the flange adjacent the second connector part when the first frame half and the second frame half are connected.

8. The assembly of claim 7 wherein the first connector part includes a head part, the second connector part includes a resilient wall, the head part abuts against the resilient wall when the first frame half is secured to the second frame half.

9. The assembly of claim 8 wherein the second connector part includes a second resilient wall spaced from the first resilient wall, the head part restrictively received between the first resilient wall and the second resilient wall when the first frame half is secured to the second frame half.

10. The window assembly of claim 8 wherein the head part has a plurality of parallel ribs extending therefrom, the resilient wall also has a rib extending therefrom, the rib of the resilient wall restrictively seated between adjacent ribs of the plurality of ribs of the head part when the first connector part is received within the second connector part, thereby securely connecting the first frame part to the second frame part.

11. The window assembly of claim 7 wherein the second frame half has a peripheral flange overlying the panel around the window opening and the slot is formed longitudinally through the flange adjacent the second connector part when the first frame half and the second frame half are connected such that the key part extends parallel over the panel when inserted through the slot to engage the second connector part.

* * * * *